US007942087B2

(12) United States Patent
Noh et al.

(10) Patent No.: US 7,942,087 B2
(45) Date of Patent: May 17, 2011

(54) SHEET PUNCHING APPARATUS AND METHOD FOR CONTROLLING THE SAME

(75) Inventors: Seung-kyoon Noh, Seoul (KR); Jae-Geol Choi, Seoul (KR)

(73) Assignees: KRDC Co., Ltd., Seoul (KR); Gradco (Japan) Ltd., Tokyo (JP)

( * ) Notice: Subject to any disclaimer, the term of this patent is extended or adjusted under 35 U.S.C. 154(b) by 814 days.

(21) Appl. No.: 11/662,410

(22) PCT Filed: Sep. 9, 2004

(86) PCT No.: PCT/KR2004/002290

§ 371 (c)(1), (2), (4) Date: Mar. 9, 2007

(87) PCT Pub. No.: WO2006/028305

PCT Pub. Date: Mar. 16, 2006

(65) Prior Publication Data

US 2008/0092704 A1 Apr. 24, 2008

(51) Int. Cl.
*B26D 5/28* (2006.01)
*B26D 5/02* (2006.01)

(52) U.S. Cl. ..... 83/76.8; 83/364; 83/368; 83/370

(58) Field of Classification Search ..... 83/368–372, 83/202, 211, 212, 76.8, 35, 36, 63, 72, 74, 83/289, 73, 343, 358, 210, 365, 209, 364; 234/126; 271/227, 245; 270/58.01, 58.07
See application file for complete search history.

(56) References Cited

U.S. PATENT DOCUMENTS 5,911,414 A * 6/1999 Kato et al. ..... 270/58.07
(Continued)

FOREIGN PATENT DOCUMENTS

JP 05-212696 A 8/1993
(Continued)

*Primary Examiner* — Laura M. Lee
(74) *Attorney, Agent, or Firm* — Birch, Stewart, Kolasch & Birch, LLP

(57) ABSTRACT

Disclosed are a sheet punching apparatus and a method for controlling the same in which the side end position of a sheet, its rear end position, a hole position, and the detachment state of a punch portion are sensed only by two sensors, and a punching hole can be formed at the exact position of a sheet by means of the two sensors. The sheet punching apparatus includes a punch portion (120) moving in a direction perpendicular to a moving direction of a sheet, a bracket (122) having an elastic member (12) to move in conjunction with the punch portion (120), a sheet side end sensing means (S10) fixed to a predetermined position of the bracket, sensing the side end of the sheet in accordance with movement of the bracket, and a sheet rear end sensing means (S20) opened to sense the rear end of the moving sheet when the bracket moves at a predetermined distance along with the punch portion to sense the side end of the sheet, wherein the punch portion (120) works to punch the sheet at a predetermined position after the rear end of the sheet is sensed by the sheet rear end sensing means.

6 Claims, 10 Drawing Sheets

U.S. PATENT DOCUMENTS

| | | | | |
|---|---|---|---|---|
| 6,386,080 | B1 * | 5/2002 | Okamoto et al. | 83/73 |
| 6,783,124 | B2 * | 8/2004 | Tamura et al. | 270/58.07 |
| 6,907,806 | B1 * | 6/2005 | Okamoto et al. | 83/76.8 |
| 6,978,925 | B2 * | 12/2005 | Morson | 234/1 |
| 7,546,081 | B2 * | 6/2009 | Tokita et al. | 399/407 |
| 2001/0049990 | A1 * | 12/2001 | Takaishi et al. | 83/628 |
| 2002/0079640 | A1 * | 6/2002 | Yoshie et al. | 271/176 |
| 2003/0024361 | A1 * | 2/2003 | Kikuchi | 83/30 |
| 2005/0155474 | A1 * | 7/2005 | Okamoto et al. | 83/76.8 |
| 2005/0212194 | A1 * | 9/2005 | Moriyama et al. | 270/58.08 |

FOREIGN PATENT DOCUMENTS

| | | | |
|---|---|---|---|
| JP | 5-212696 | A | 8/1993 |
| JP | 6-55500 | A | 3/1994 |
| JP | 06-55500 | A | 3/1994 |
| JP | 14-200594 | A | 7/2002 |
| JP | 2002-200594 | A | 7/2002 |
| JP | 15-145491 | A | 5/2003 |
| JP | 2003-145491 | A | 5/2003 |

* cited by examiner

SHEET PUNCHING APPARATUS AND METHOD FOR CONTROLLING THE SAME

TECHNICAL FIELD

The present invention relates to a sheet punching apparatus that punches a sheet ejected from a printer and a copier, and more particularly to a sheet punching apparatus and a method for controlling the same that corrects the position of a punching hole depending on the position of sheets ejected from an image forming apparatus to punch sheets at the same position.

BACKGROUND ART

A sheet punching apparatus should be operated in such a manner that sheets are punched at the same position for exact alignment.

However, the punching position per sheet may be varied due to deviation or distortion in the position of feeding sheets. Ends of punched sheets may not be aligned exactly.

To solve such problems, a related art sheet punching apparatus is disclosed in Japanese Patent Publication No. 2002-200593. In this related art, the end position of sheets is sensed by a sensor and a punch portion of a sheet punching apparatus is moved in a width direction of sheets in accordance with the sensed result to adjust the position of the punch portion, thereby enabling punching of the sheets at the center in the width direction of sheets.

The related art sheet punching apparatus will be described with reference to FIGS. 1 and 2.

The sheet punching apparatus 1 is arranged along a direction perpendicular to a feeding direction of a sheet S. The sheet punching apparatus 1 includes a male punch 2 and a female punch 3. The female punch 3 is arranged below the male punch 2 to oppose the male punch 2 around a feeding path D of the sheet S. In the male punch 2, a rotary shaft 4 is fixed to a support 5 in a direction perpendicular to the feeding direction of the sheet S. The rotary shaft 4 is provided with a cam 6 that adjoins the top of the male punch 2. The top of the male punch 2 adjoins the cam 6 by means of an elastic support (not shown).

In the aforementioned related sheet punching apparatus, the face of the cam 6 pushes the top of the male punch 2 as the rotary shaft 4 rotates. As a result, the male punch 2 is moved to the female punch 3 so that a predetermined position of the sheet S is punched.

An upper guide 7*a* constituting a sheet guide portion along the upper side of the feeding path P of the sheet S is disposed below the male punch 2. A lower guide 7*b* is disposed above the female punch 3 to facilitate guide of the sheet.

In the aforementioned related art punching apparatus, the male punch 2, the female punch 3, the rotary shaft 4, and the upper and lower guides 7*a* and 7*b* are fixed to the support 5 in a single body.

A rack gear 8 is provided at one end of the support 5. The rack gear 8 is engaged with a pinion gear 10 provided in a driving motor 9. Once the driving gear 9 rotates in a forward or reverse direction, the driving force is transmitted to the sheet punching apparatus 1 through the pinion gear 10 and the rack gear 8. Thus, the sheet punching apparatus 1 is moved to the direction perpendicular to the feeding direction of the sheet S.

In the aforementioned related art sheet punching apparatus, a sheet sensing means 11 is provided to sense the side and the end parallel to the feeding direction of the sheet S.

The sheet sensing means 11 includes reflecting photo sensors S1, S2, S3, S4, and S5 provided in the upper guide 7*a* along the direction perpendicular to the feeding direction of the sheet S to correspond to the width of various sized sheets to be punched.

The upper guide 7*a* is provided with a receiving hole 12 corresponding to the sensors S1~S5. The respective sensors S1~S5 transmit light to the lower guide 7*b* through the receiving hole 12 and sense the side end of the sheet S by means of the intensity of the reflecting light.

That is, once the sheet punching apparatus 1 moves to an arrow of FIG. 2, the sheet sensing means 11 provided in the upper guide 7*a* is moved from the inner side of the side end of the sheet S to its outer side. At this time, the side end of the sheet S is sensed by the intensity of the reflecting light and the punching apparatus is moved to the punching position in accordance with the sensed result.

As aforementioned, since the sheet sensing means 11 moving along with the sheet punching apparatus is provided in the sheet punching apparatus, the whole moving amount is small and punching efficiency can be improved. However, there are still problems. That is, a separate sensor that senses a hole position of the punching apparatus is required and the sensor provided in the punching apparatus cannot sense whether the punching apparatus is detached or not.

DETAILED DESCRIPTION OF THE INVENTION

Technical Problem

Accordingly, the present invention is directed to a sheet punching apparatus and a method for controlling the same that substantially obviates one or more of the problems due to limitations and disadvantages of the related art.

An object of the present invention is to provide a sheet punching apparatus in which the side end position of a sheet, its rear end position, a hole position, and the detachment state of a punch portion are sensed only by two sensors.

Another object of the present invention is to provide a method for controlling a sheet punching apparatus in which a punching hole can be formed at the exact position of a sheet by means of a small number of sensors.

Technical Solution

To achieve these and other advantages and in accordance with the purpose of the present invention, as embodied and broadly described, a sheet punching apparatus of the present invention includes a punch portion 120 moving in a direction perpendicular to a moving direction of a sheet, a bracket 122 having an elastic member 12 to move in conjunction with the punch portion 120, a sheet side end sensing means S10 fixed to a predetermined position of the bracket, sensing the side end of the sheet in accordance with movement of the bracket, and a sheet rear end sensing means S20 opened to sense the rear end of the moving sheet when the bracket moves at a predetermined distance along with the punch portion to sense the side end of the sheet, wherein the punch portion 120 works to punch the sheet at a predetermined position after the rear end of the sheet is sensed by the sheet rear end sensing means.

The punch portion 120 linked to the bracket 122 includes a sheet guide 107 at a lower portion, and a receiving hole SH10 of the sheet side end sensing means and a receiving hole SH20 of the sheet rear end sensing means are respectively provided on the sheet guide 107.

The receiving hole SH10 of the sheet side end sensing means has a size corresponding to a sensing region of the sheet side end sensing means regardless of the moving position of the bracket, and the receiving hole SH20 of the sheet rear end sensing means is disconnected with the sheet rear end sensing means by a bracket face 122*a* when the bracket is in a hole position while it is connected with the sheet rear end sensing means when the bracket moves at a predetermined distance from the hole position.

The sheet rear end sensing means S20 is fixed onto the sheet guide 107 to face the receiving hole SH20 around the bracket face 122*a*.

The elastic member and the bracket 122 are inserted into a slide rod 123 provided on the sheet guide 107 and are slid along the moving direction of the punch portion 120, the bracket being pushed by the elastic member to be closely fixed to a projection 124 of the punch portion.

In another aspect, in a method for controlling a sheet punching apparatus including a punch portion 120 moving in a direction perpendicular to a moving direction of a sheet, a bracket 122 having an elastic member 12 to move in conjunction with the punch portion 120, a sheet side end sensing means S10 fixed to a predetermined position of the bracket, sensing the side end of the sheet in accordance with movement of the bracket, a sheet rear end sensing means S20 opened to sense the rear end of the moving sheet when the bracket moves at a predetermined distance along with the punch portion to sense the side end of the sheet, a sheet guide 107 provided at a lower portion of the punch portion linked to the bracket, having a receiving hole SH10 of the sheet side end sensing means and a receiving hole SH20 of the sheet rear end sensing means, the sheet rear end sensing means S20 being fixed onto the sheet guide 107 to face the receiving hole SH20 around a bracket face 122*a*, the method for controlling a sheet punching apparatus includes the steps of determining that the punch portion 120 is positioned in a hole position when the bracket face 122*a* is positioned between the sheet rear end sensing means S10 and the receiving hole SH10 of the sheet rear end sensing means, moving the bracket 122 linked to the punch portion 120 from the hole position when the sheet is moving through the sheet guide to release the sheet rear end sensing means S20 and the receiving hole SH20 disconnected by the bracket 122*a*, stopping movement of the bracket 122 and the punch portion 120 when the side end of the moving sheet is sensed between the sheet side end sensing means S10 and its receiving hole SH10, sensing the rear end of the sheet moving between the sheet rear end sensing means S20 and its receiving hole SH20 in a state that the bracket 122 and the punch portion 120 are stopped, working the punch portion 120 after the rear end of the sheet is sensed, to form a punching hole at a predetermined position of the moving sheet, and moving the bracket 122 and the punch portion 120 to the hole position after punching the sheet.

Advantageous Effects

The sheet punching apparatus according to the present invention has the following advantages.

The sheet punching apparatus includes a punch portion 120 moving in a direction perpendicular to a moving direction of a sheet, a bracket 122 having an elastic member 121 to move in conjunction with the punch portion 120, a sheet side end sensing means S10 fixed to a predetermined position of the bracket, sensing the side end of the sheet in accordance with movement of the bracket, and a sheet rear end sensing means S20 opened to sense the rear end of the moving sheet when the bracket moves at a predetermined distance along with the punch portion to sense the side end of the sheet, wherein the punch portion 120 works to punch the sheet at a predetermined position after the rear end of the sheet is sensed by the sheet rear end sensing means. By this structure, the side end position of the sheet, its rear end position, a hole position, and the detachment state of the punch portion are sensed only by two sensors. A punching hole can be formed at the exact position of the sheet by means of the two sensors.

BEST MODE

Reference will now be made in detail to the preferred embodiments of the present invention, examples of which are illustrated in the accompanying drawings.

Figure 1:
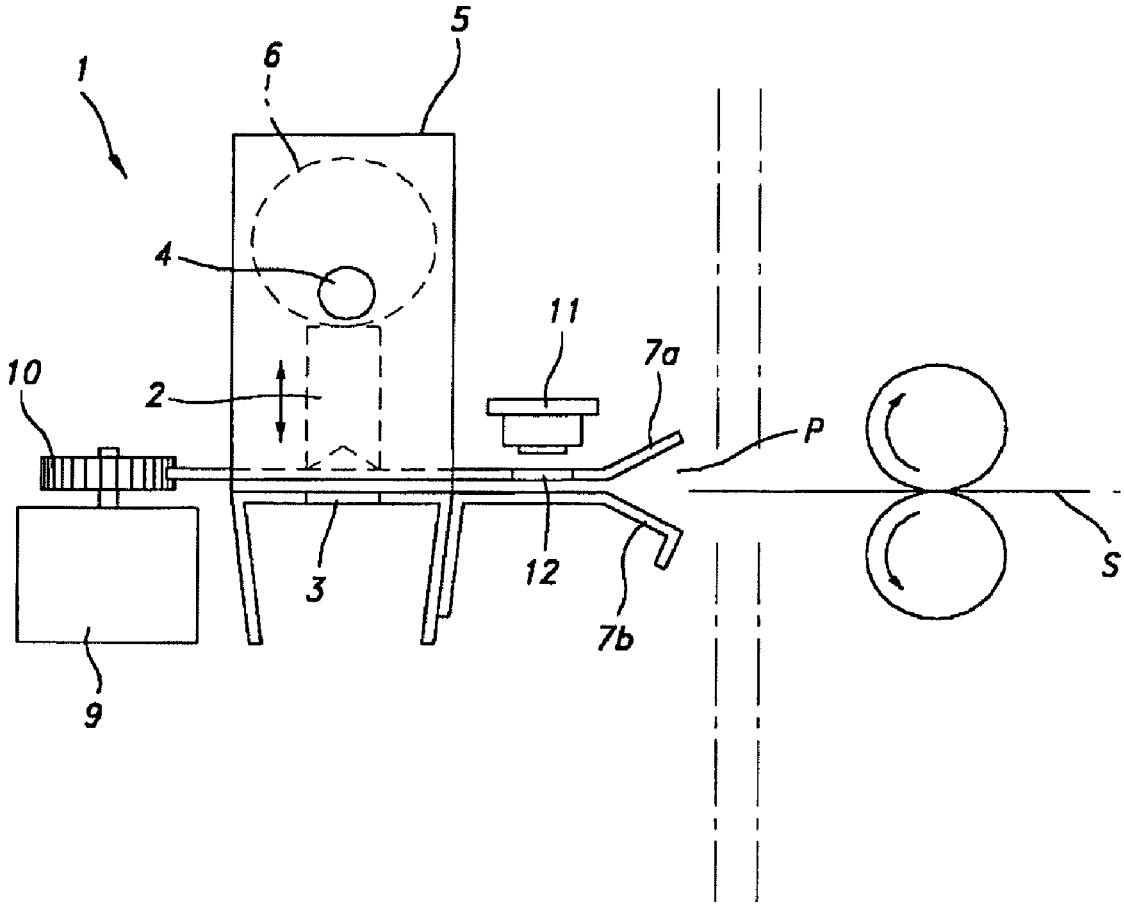
Prior Art Fig 1
FIG. 1 is a side sectional view illustrating a related art sheet punching apparatus.
Figure 2:
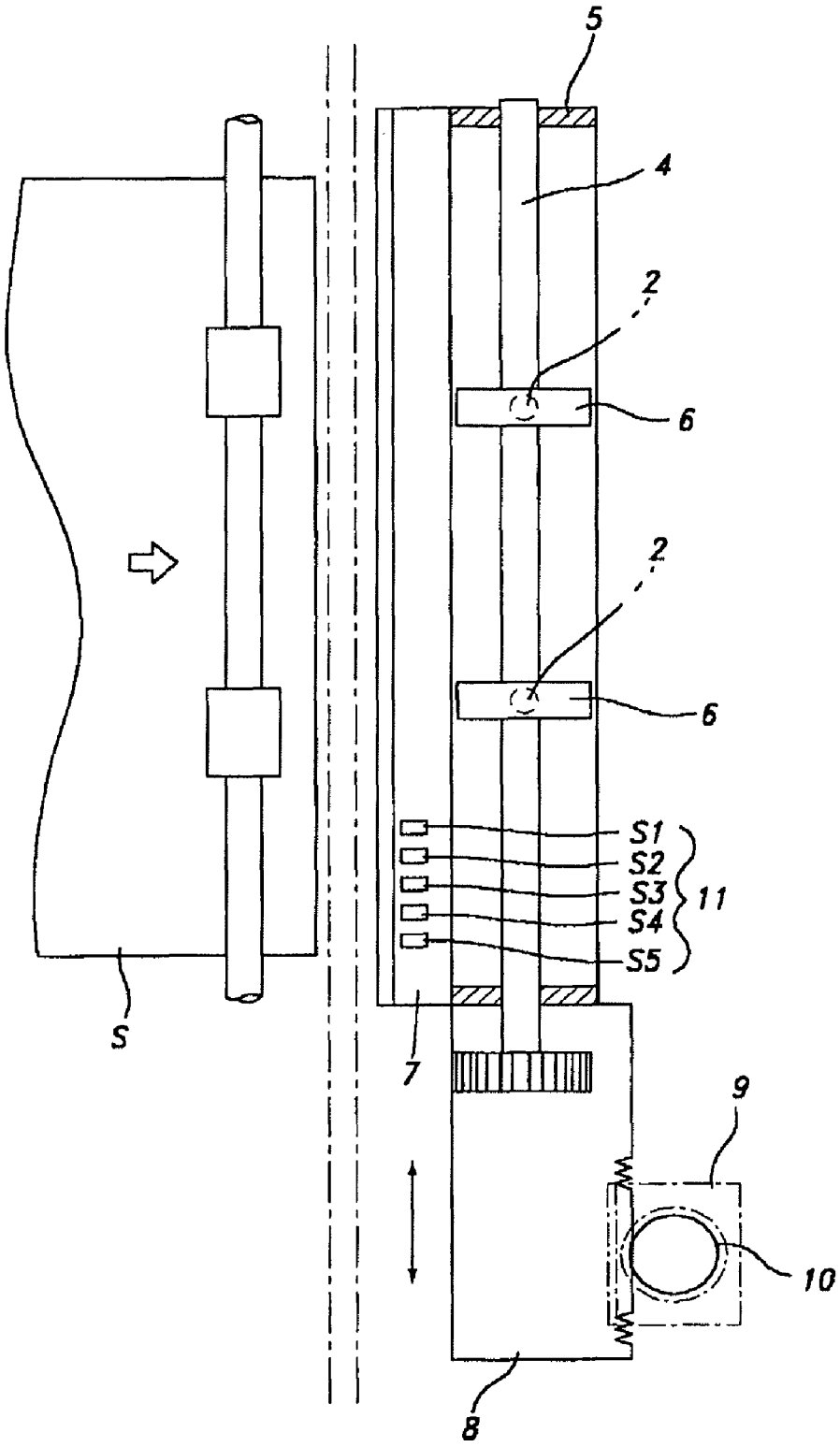
Prior Art Fig 2
FIG. 2 is a plane view illustrating a related art sheet punching apparatus.
Figure 3:
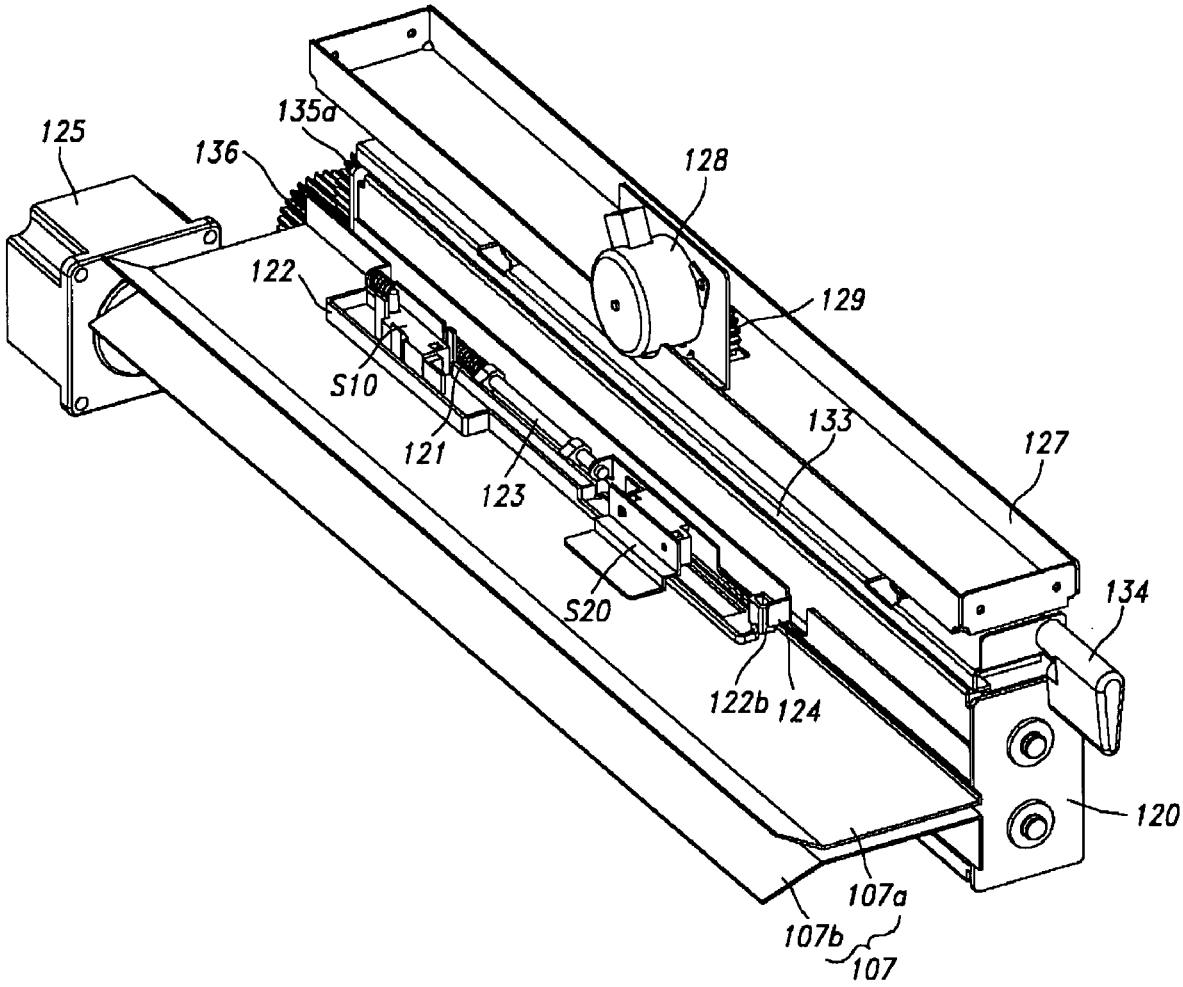
FIG. 3 is an elevational view illustrating a sheet punching apparatus according to the present invention.
Figure 4:
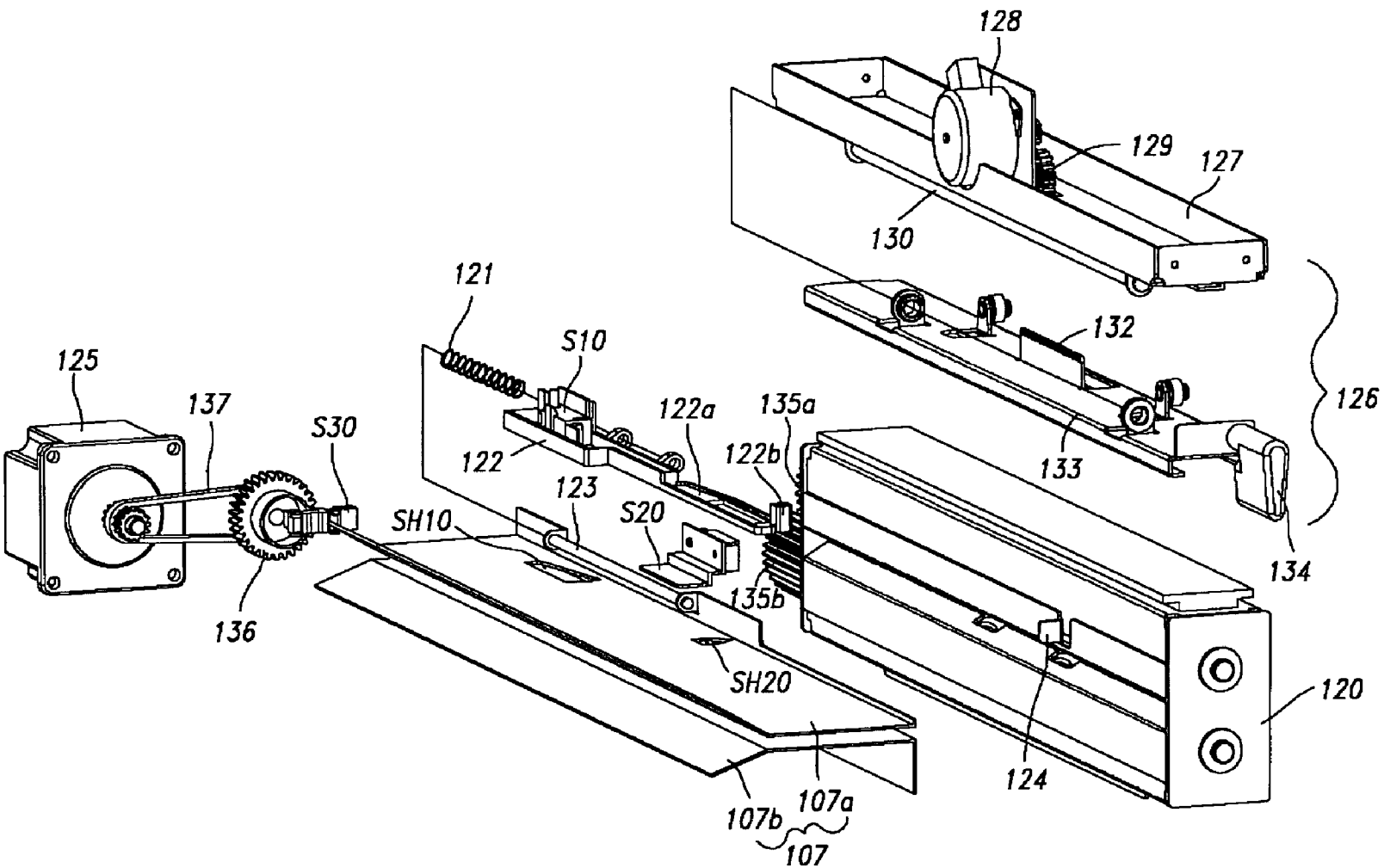
FIG. 4 is an exploded perspective view illustrating a sheet punching apparatus according to the present invention.
Figure 5:
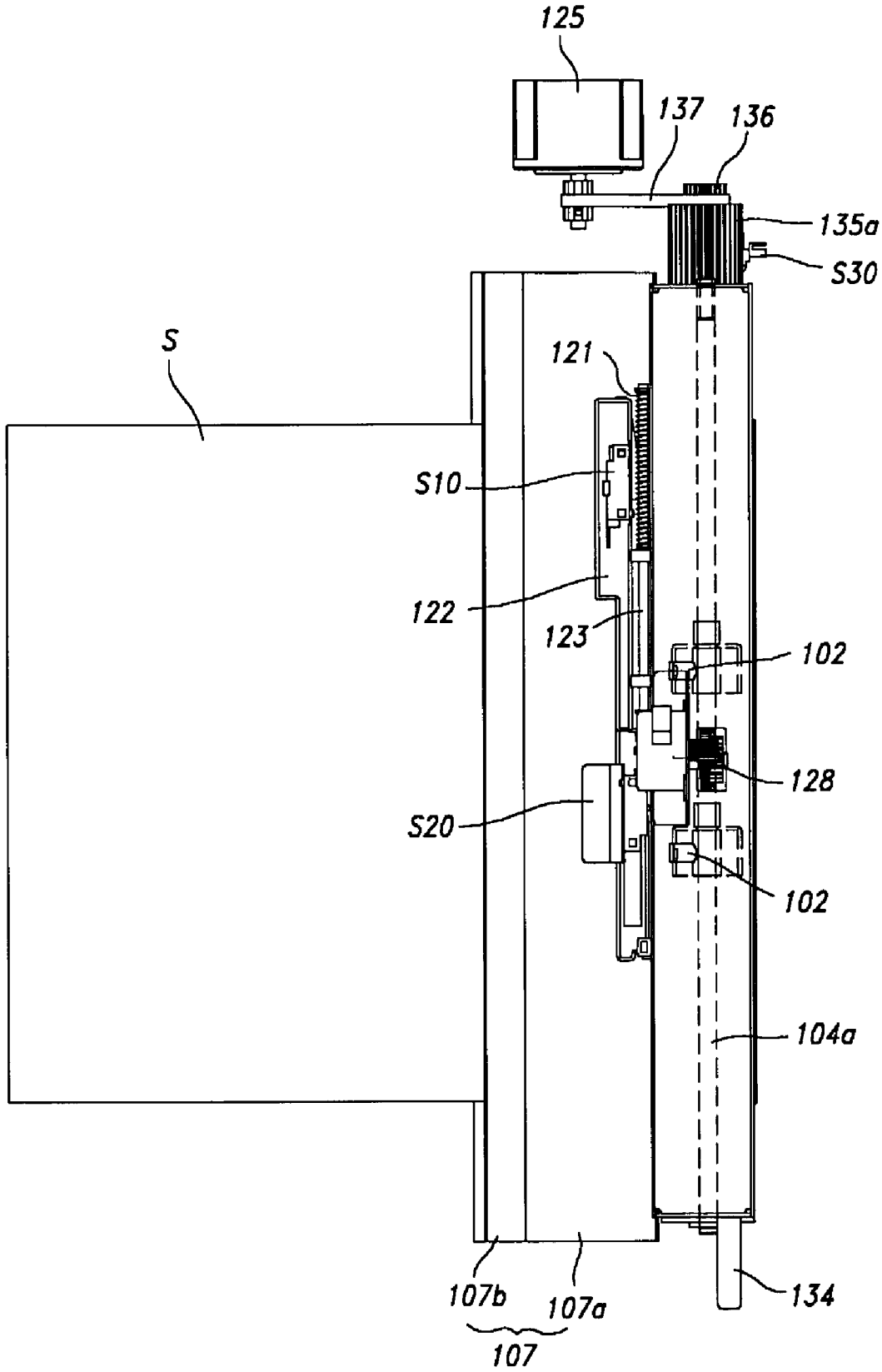
FIG. 5 is a plane view illustrating a sheet punching apparatus according to the present invention.
Figure 7:
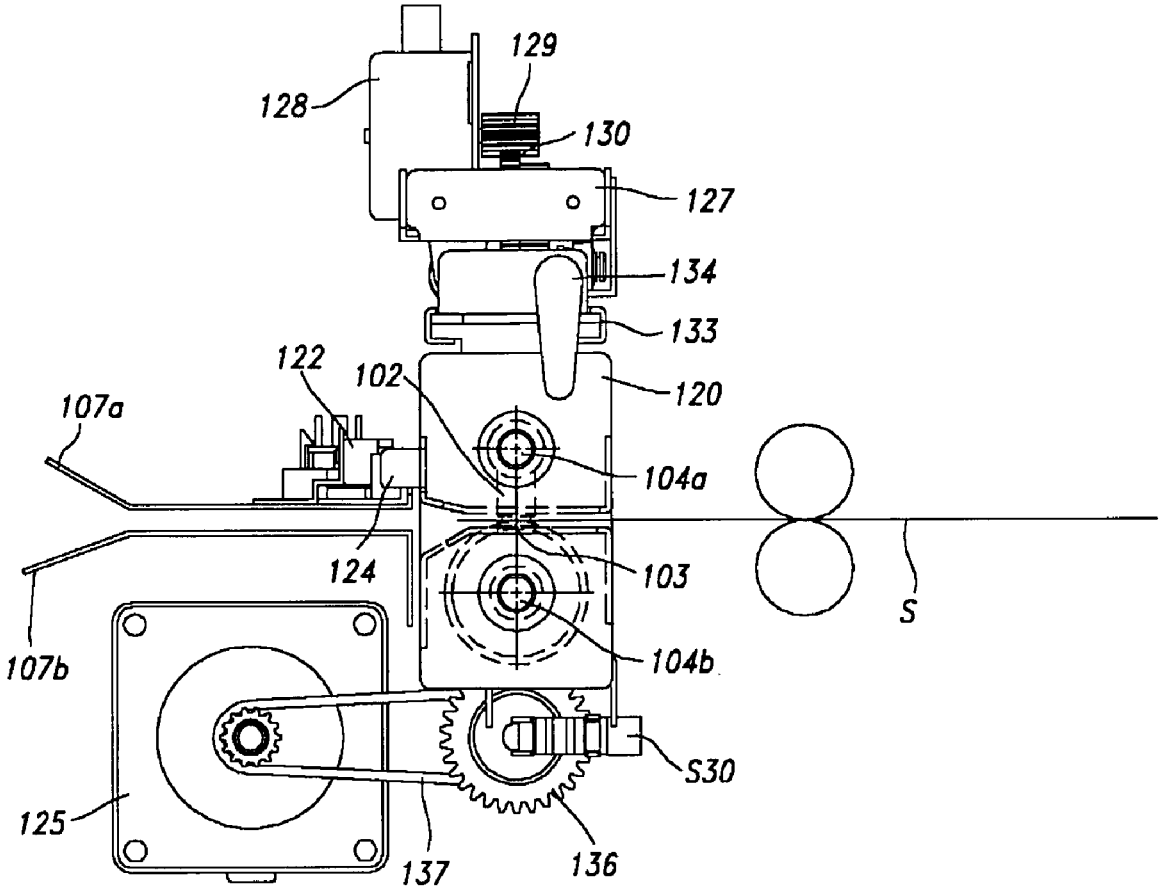

A sheet punching apparatus according to the present invention will be described with reference to FIG. 3 and FIG. 7.

A sheet punching apparatus 101 of the present invention includes female and male punches 103 and 102 respectively fixed to a female punch clamp shaft 104*b* and a male punch clamp shaft 104*a*, a punch portion 102 provided with a punch motor 125 that simultaneously rotates the female punch clamp shaft 104*b* and the male punch clamp shaft 104*a* to form a punching hole in a sheet S passing between the female punch and the male punch engaged with each other, a bracket 122 linked to the punch portion 102, a punch portion moving means 126 moving the punch portion and the bracket in a direction perpendicular to a feeding direction of the sheet S, and a sheet guide 107 guiding the sheet S to move between the female punch clamp shaft 104*b* and the male punch clamp shaft 104*a*.

The sheet guide 107 includes an upper guide plate 107*a* and a lower guide plate 107*b*. A slide rod 123 is provided on the upper guide plate 107*a* to move the bracket 122 and the punch portion together. That is, the bracket is fixed to the slide rod 123 so that it is linked to the punch portion.

An elastic member 121 such as a spring is inserted into the side end of the bracket so that the punch portion and the bracket can move together. To this end, the elastic member 121 pushes the bracket 122 to a projection 124 formed on a wall of the punch portion 120 and elastically supports the bracket.

Meanwhile, a sheet side end sensor S10 is fixed to the bracket 122 and senses the side end of the sheet S. A sheet rear end sensor S20 is fixed onto the upper guide plate 107*a* of the sheet guide and senses the rear end of the sheet S.

A receiving hole SH10 of the sheet side end sensor and a receiving hole SH20 of the sheet rear end sensor are respectively provided on the upper guide plate 107*a* and the lower guide plate 107*b*. When the punch portion 120 is in a hole position, a bracket face 122*a* is interposed between the sheet rear end sensor S20 and its receiving hole SH20 to disconnect the sheet rear end sensor S20 and its receiving hole. Once the punch portion 120 is moved from the hole position, the bracket face 122*a* is moved along with the punch portion so that the disconnection of the sheet rear end sensor S20 is released.

The receiving hole SH10 of the sheet side end sensor has a slit shape so as to be always within a sensing area of the sheet side end sensor S10 regardless of the moving position of the bracket 122. The sheet side end sensor S10 is fixed to the bracket 122 regardless of the moving position of the bracket 122 so that it is not disconnected by the bracket face 122*a*.

The punch portion moving means 126 includes a punch portion moving motor 128 provided on a punch portion moving frame 127, a pinion gear 129 linked to the moving motor 128, a punch portion slide rod 130 provided at the lower portion of the punch portion moving frame 127, a punch portion clamp handle 131 sliding in a state that it is inserted into the slide rod 130, and a rack gear 132 provided on the punch portion clamp handle and engaged with the pinion gear 129.

A punch portion clamp unit 133 is provided at the lower portion of the punch portion clamp handle 131 and is slid in a state that the punch portion 120 is inserted thereto. A flange grip 134 adjoining the punch portion is provided at one side of the clamp handle.

Meanwhile, the female punch clamp shaft 104*b* and the male punch clamp shaft 104*a* are respectively linked to punch gears 135*a* and 135*b* engaged with each other. One of the punch gears is engaged with a punch driving pulley 136. The punch driving pulley 136 and the punch motor 125 are linked to each other by a driving belt 137. The punch driving pulley 136 is provided with a punch rotational sensor S30 that senses rotation of the female and male clamp shafts.

The operation for controlling the aforementioned sheet punching apparatus of the present invention will be described in more detail with reference to a flow chart of FIG. 11 and FIGS. 6 to 10.

Once an initial signal of the sheet punching apparatus is input to a central processing unit (not shown), the central processing unit determines whether the sheet side end sensor S10 is in OFF state while the sheet rear end sensor S20 is in ON state in step S101.

The ON/OFF state of the sheet side end sensor S10 and the sheet rear end sensor S20 is controlled by the reflecting intensity of light irradiated onto the respective receiving holes SH10 and SH20.

Figure 8:
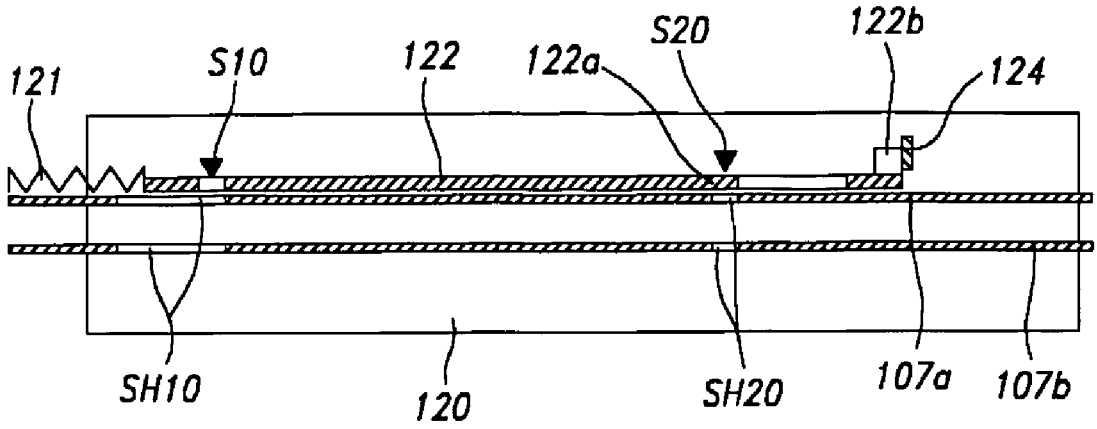
FIGS. 8, 9 and 10 illustrate the operational state of a sheet punching apparatus according to the present invention.

Therefore, to keep the sheet side end sensor S10 in OFF state and the sheet rear end sensor S20 in ON state, as shown in FIG. 8, the sheet rear end sensor S20 and its receiving hole SH20 are disconnected by the bracket face 122*a* so that the light emitted through the sheet rear end sensor S20 is reflected on the bracket face 122*a*. As a result, the sheet rear end sensor S20 is to be in ON state. On the other hand, the sheet side end sensor S10 and its receiving hole SH10 are not disconnected by the bracket face (no sheet is provided) so that the sheet side end sensor S20 is to be in OFF state.

If the condition that the sheet rear end sensor S20 is in ON state and the sheet side end sensor S10 is in OFF state is not fulfilled, the central processing unit determines whether both the sheet side end sensor S10 and the sheet rear end sensor S20 are in OFF state in step S102.

If both the sheet side end sensor and the sheet rear end sensor are in OFF state, the punch portion moving motor 128 is driven in step S103 to move the punch portion to the hole position. Thus, the central processing unit determines again in step S104 whether the sheet rear end sensor S20 is in ON state and the sheet side end sensor S10 is in OFF state as shown in FIG. 8. If so, the operation of the punch portion moving motor 128 is stopped in step S106.

Figure 9:
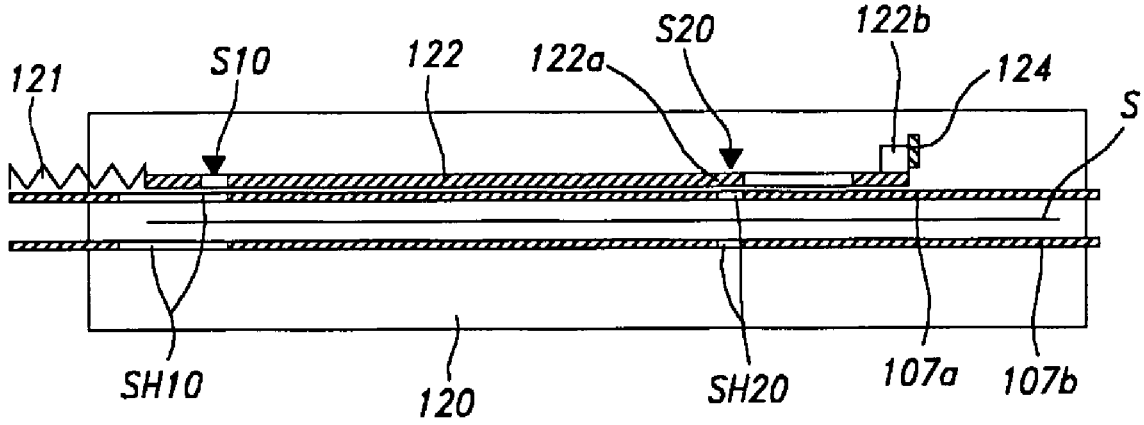
Figure 10:
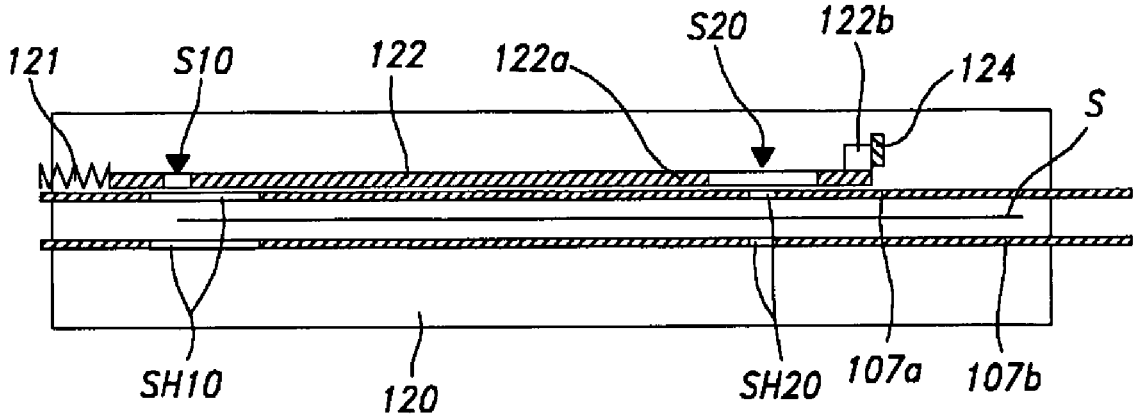
Figure 11:
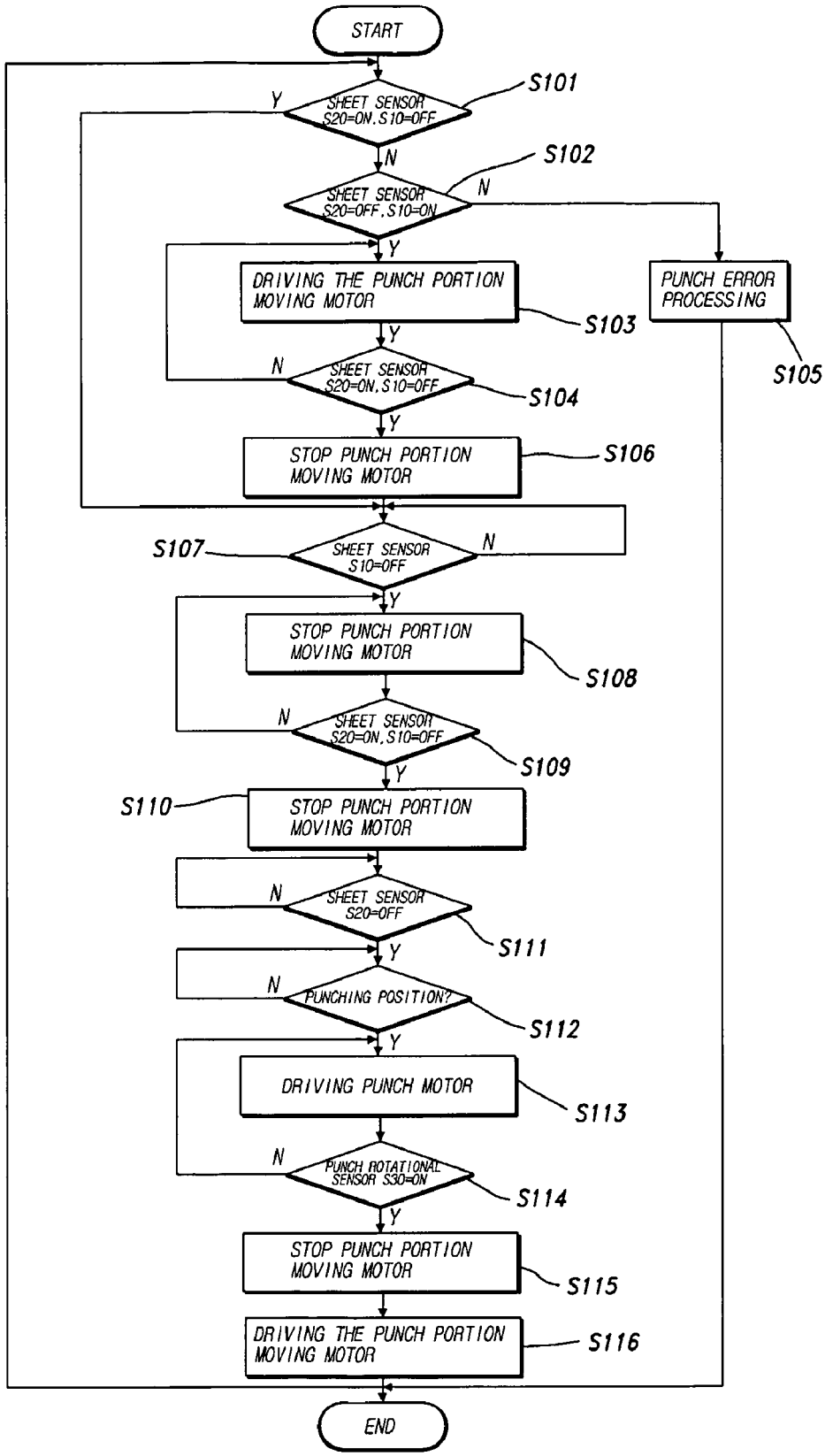
FIG. 11 is a flow chart illustrating the operation of a sheet punching apparatus according to the present invention.

If the condition that the sheet rear end sensor S20 is in ON state and the sheet side end sensor S10 is in OFF state is not fulfilled, the sheet S may remain in the sheet guide 107 as shown in FIG. 9. Therefore, the step S103 is proceeded and the punch portion moving motor 128 continues to be driven until the sheet side end sensor S10 is in ON state, that is, the sheet side end sensor S10 senses the end of the sheet S as shown in FIG. 10.

If both the sheet side end sensor S10 and the sheet rear end sensor S20 are not in OFF state in step S102, the sheet S may be jammed between the sheet guides before the punch portion 120 is initiated or the position of the sheet rear end sensor S20 may be distorted. Thus, an error processing signal is generated in step S105 so that jam of the sheet S is released or the position of the sheet rear end sensor S20 is controlled.

Meanwhile, if it is determined that the sheet side end sensor S10 is in OFF state and the sheet rear end sensor S20 is in ON state in step S101, the sheet for punching is in standby state.

Once the sheet for punching is fed to the sheet side end sensor S10, the sheet side end sensor S10 is changed from the OFF state to the ON state in step S107. At this time, the punch portion moving motor is driven in step S108.

Once the punch portion moving motor is driven, its rotational force is transmitted to the rack gear 132 of the punch portion clamp handle and the punch portion is locked in the flange grip 134 provided at one side of the punch portion clamp handle. As a result, the punch portion is moved in a direction perpendicular to the moving direction of the sheet S.

When the punch portion moves, the projection 124 of the punch portion pushes the side of the bracket 122 provided in the slide rod 123 on the sheet guide so that the punch portion and the bracket moves together.

If the punch portion moves reversely, the bracket 122 is pushed by elastic force of the spring 121 provided in the slide rod 123 of the sheet guide so that the side end 122*b* of the bracket is closely fixed to the projection 124 of the punch portion and is moved along with the punch portion.

Once the sheet rear end sensor S20 is in ON state and the sheet side end sensor S10 is in OFF state in step S109, the operation of the punch portion moving motor 128 is stopped in step S110. Then, the central processing unit determines whether the sheet rear sensor S20 is in OFF state in step S111.

As shown in FIG. 10, the sheet continues to move in a state that the sheet side end sensor S10 is in OFF state as the end of the sheet S is sensed. Then, the rear end of the sheet S passes through between the sheet rear end sensor S20 and its receiving hole SH20. In this case, since the sheet rear end sensor S20 is changed from the ON state to the OFF state, the central processing unit senses this state and determines that the rear end of the sheet S has passed. In other words, once the punch portion 120 and the bracket 122 move to sense the side end of the sheet, the sheet rear end sensor S20 and its receiving hole SH20 disconnected by the bracket face 122*a* are released. In this case, the sheet rear end sensor S20 should be in OFF state. However, the sheet rear end sensor S20 is maintained in ON state not OFF state as the sheet S serves as a shielding film while the sheet S is feeding. The sheet rear end sensor S20 is changed from the ON state to the OFF state when the rear end of the sheet S passes. Then, the central processing unit determines that the rear end of the sheet S has passed by sensing the signal change of the sheet rear end sensor S20.

Once the sheet rear end sensor S20 is changed to the OFF state, the central processing unit determines whether the sheet S has been moved to the punching position by counting a predetermined interval time period (for example, 0.2 second to 0.5 second) in step S112. If it is determined that the sheet has been moved to the punching position, the central processing unit drives the punch motor 125 in step S113.

The punch motor 125 is driven as follows.

Figure 6:
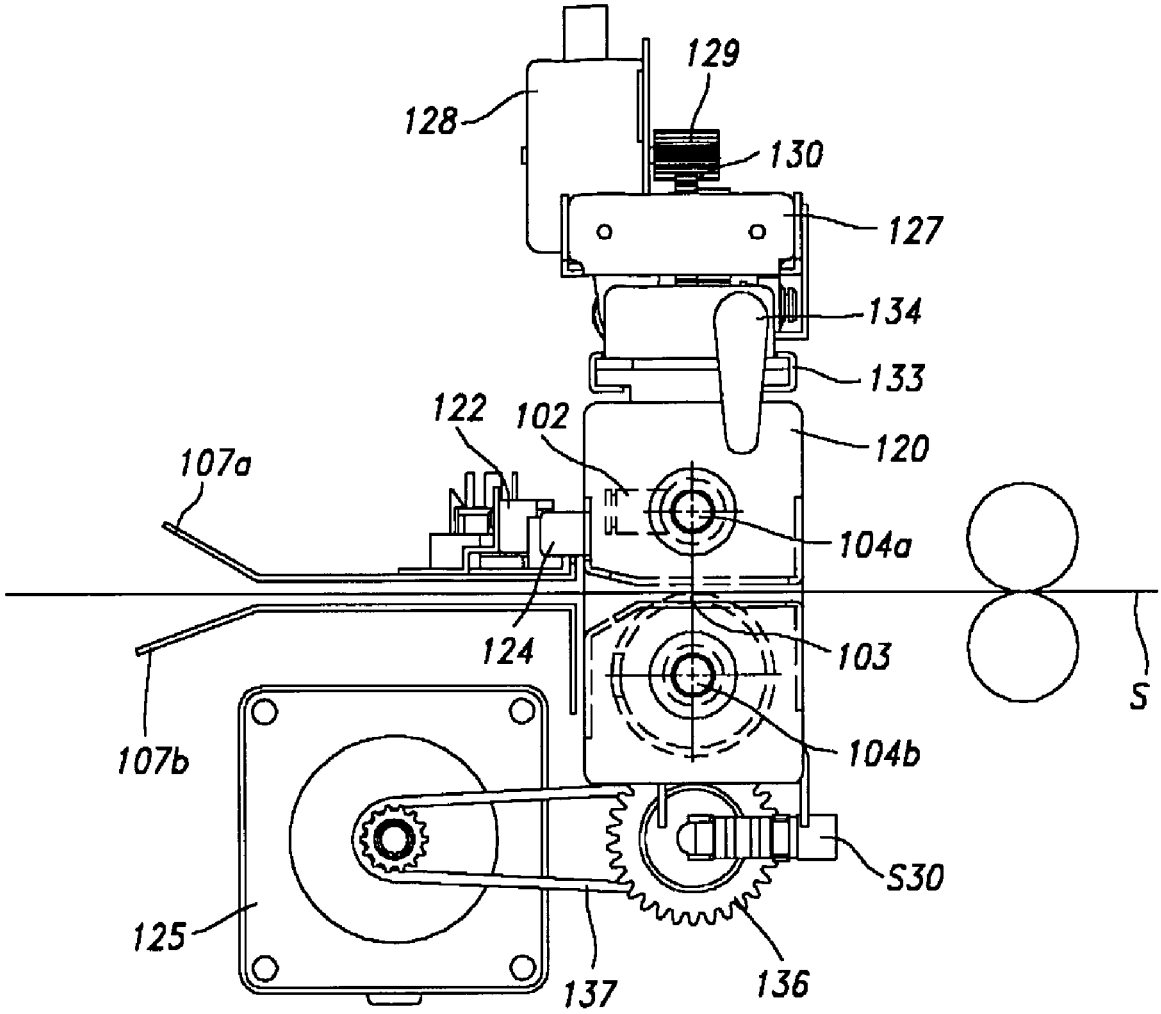
FIGS. 6 and 7 are side sectional views illustrating a sheet punching apparatus according to the present invention.

The male punch 102 and the female punch 103 fixed to the respective clamp shaft are in standby state in a state that it is engaged with each other as shown in FIG. 6 while the sheet S is feeding. Once the sheet S has been fed to the punching position as shown in FIG. 7, the punch motor 125 is driven so that the male punch clamp shaft 104*a* and the female punch clamp shaft 104*b* are rotated, thereby forming a punching hole in the sheet S passing through between the clamp shafts.

The central processing unit senses the ON/OFF signal of the punch rotational sensor S30 fixed to the punch driving pulley 136 to determine whether the punching hole has been formed in step S114. If it is determined that the punching hole has been formed, the central processing unit stops the punch motor in step S115.

Afterwards, the punch portion moving motor 128 is driven in step S116. The punch portion 120 is then moved to the hole position and initiated.

The punch portion is moved to the hole position along with the bracket 122 in such a manner that the punch portion clamp handle 134 is slid to the original position by reversely rotating the punch portion moving motor and the side end 122*b* of the bracket pushes the projection 124 of the punch portion by the elastic force of the spring 121.

The hole position of the sheet punch portion corresponds to the position where the sheet rear end sensor S20 is in ON state by being shielded by the bracket 122*a*.

Figure 12:
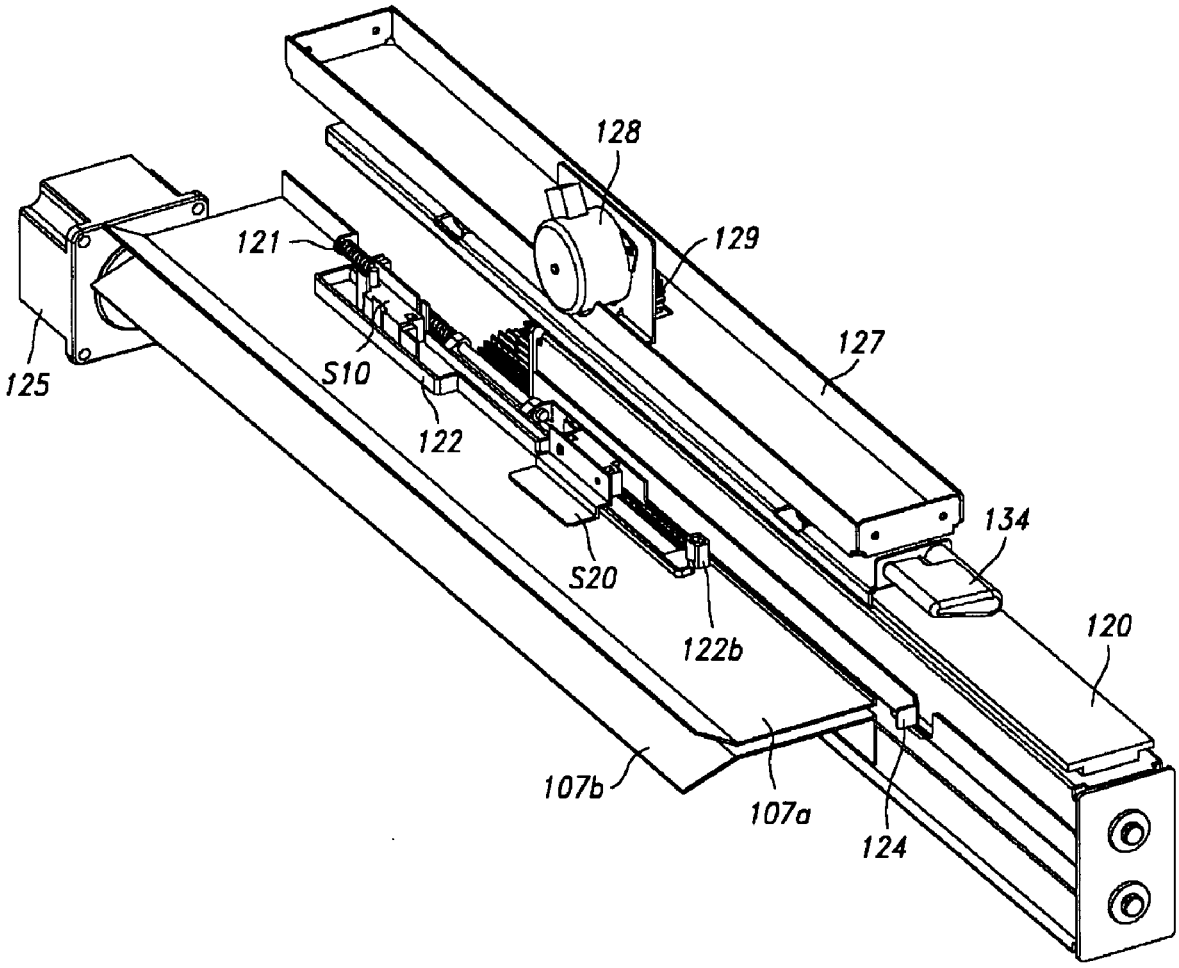
FIG. 12 illustrates a detachment structure of a sheet punching apparatus according to the present invention.

As shown in FIG. 12, the flange grip 134 provided in the punch portion clamp handle 131 can axially be rotated at a predetermined angle so that the punch portion is easily detached.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A sheet punching apparatus comprising:

a punch portion moving in a direction perpendicular to a moving direction of a sheet;

a bracket having an elastic member to move in conjunction with the punch portion;

a sheet side end sensing means fixed to a predetermined position of the bracket, sensing the side end of the sheet in accordance with movement of the bracket; and a sheet rear end sensing means opened to sense the rear end of the moving sheet when the bracket moves at a predetermined distance along with the punch portion to sense the side end of the sheet, wherein the punch portion works to punch the sheet at a predetermined position after the rear end of the sheet is sensed by the sheet rear end sensing means, and wherein the elastic member and the bracket are inserted into a slide rod provided on a sheet guide and are slid along the moving direction of the punch portion, the bracket being pushed by the elastic member to be closely fixed to a projection of the punch portion.

2. The sheet punching apparatus according to claim 1, wherein the punch portion linked to the bracket includes the sheet guide at a lower portion, and a receiving hole of the sheet side end sensing means and a receiving hole of the sheet rear end sensing means are respectively provided on the sheet guide.

3. The sheet punching apparatus according to claim 1, wherein a receiving hole of the sheet side end sensing means has a size corresponding to a sensing region of the sheet side end sensing means regardless of the moving position of the bracket, and a receiving hole of the sheet rear end sensing means is disconnected with the sheet rear end sensing means by a bracket face when the bracket is in a first position while it is connected with the sheet rear end sensing means when the bracket moves at a predetermined distance from the first position.

4. The sheet punching apparatus according to claim 1, wherein the sheet rear end sensing means is fixed onto the sheet guide to face a receiving hole around a bracket face.

5. The sheet punching apparatus according to any one of claims 1 to 4, wherein the sheet rear end sensing means senses the hole position of the punch portion.

6. The sheet punching apparatus according to any one of claims 1 to 4, wherein the punch portion further includes a punch rotational sensor that senses the punching operation of the punch portion.

* * * * *